US010636363B2

(12) United States Patent
Feng

(10) Patent No.: US 10,636,363 B2
(45) Date of Patent: Apr. 28, 2020

(54) SIGNAL PROCESSING CIRCUIT AND METHOD FOR DRIVING THE SAME, DISPLAY PANEL AND DISPLAY DEVICE

(71) Applicants: HEFEI XINSHENG OPTOELECTRONICS TECHNOLOGY CO., LTD., Hefei, Anhui (CN); BOE TECHNOLOGY GROUP CO., LTD., Beijing (CN)

(72) Inventor: Xuehuan Feng, Beijing (CN)

(73) Assignees: HEFEI XINSHENG OPTOELECTRONICS TECHNOLOGY CO., LTD., Hefei, Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/268,426

(22) Filed: Feb. 5, 2019

(65) Prior Publication Data

US 2019/0362677 A1 Nov. 28, 2019

(30) Foreign Application Priority Data

May 22, 2018 (CN) ..... 2018 1 0496019

(51) Int. Cl.
*G09G 3/3266* (2016.01)

(52) U.S. Cl.
CPC ... *G09G 3/3266* (2013.01); *G09G 2300/0426* (2013.01); *G09G 2310/0286* (2013.01); *G09G 2330/028* (2013.01)

(58) Field of Classification Search
CPC ..... G09G 3/3266; G09G 2330/028; G09G 2310/0286; G09G 2300/0426; G09G 3/3208
See application file for complete search history.

(56) References Cited

U.S. PATENT DOCUMENTS

2012/0008731 A1* 1/2012 Hsu ..... G11C 19/28 377/79
2015/0206597 A1* 7/2015 Liao ..... G11C 19/28 377/70
2016/0275849 A1* 9/2016 Tsai ..... G09G 3/3677
2016/0358572 A1* 12/2016 Xiao ..... G11C 19/287

* cited by examiner

*Primary Examiner* — Premal R Patel
(74) *Attorney, Agent, or Firm* — Nath, Goldberg & Meyer; Joshua B. Goldberg

(57) ABSTRACT

Provided are a signal processing circuit and a method for driving the same, a display panel, and a display device. The signal processing circuit includes: an output circuit and a plurality of first input control circuits; each of the input control circuits has a corresponding pulse signal input terminal. All input control circuits and the output circuit are coupled at a first node. Each of the input control circuits may input a first operating voltage supplied from a first power supply terminal to the first node in certain cases. The output circuit may output an active-level voltage supplied from an active-level providing terminal or an inactive-level voltage supplied from an inactive-level providing terminal to the signal output terminal in certain cases.

20 Claims, 6 Drawing Sheets

SIGNAL PROCESSING CIRCUIT AND METHOD FOR DRIVING THE SAME, DISPLAY PANEL AND DISPLAY DEVICE

CROSS-REFERENCE TO RELATED APPLICATIONS

The present application claims the priority of Chinese Patent Application No. 201810496019.8, filed on May 22, 2018, the content of which is incorporated herein by reference in its entirety.

TECHNICAL FIELD

The present disclosure relates to the field of display technologies, and in particular, to a signal processing circuit and a method for driving the same, a display panel, and a display device.

BACKGROUND

A related display panel is mainly driven by a way of progressive scan. Specifically, when a gate line is scanned, a single-pulse gate driving signal needs to be output to the gate line through a gate driver. However, in an organic light emitting diode (OLEO) display panel, a multi-pulse gate driving signal is required for driving the gate line, in consideration of pixel compensation.

SUMMARY

According to an aspect of the disclosure, a signal processing circuit is provided. The signal processing circuit include a first-level providing terminal, a second-level providing terminal, a first power supply terminal, a second power supply terminal, a signal output terminal, an output circuit, and a plurality of first input control circuits. The output circuit is coupled to the first-level providing terminal, the second level-providing terminal, the second power supply terminal, and the signal output terminal. Each of the plurality of first input control circuits is coupled to the first power supply terminal, coupled to the output circuit at a first node, and has a signal input terminal. Each of the plurality of first input control circuits is configured to input a first operating voltage supplied from the first power supply terminal to the first node in a case that a signal supplied to the signal input terminal of the first input control circuit is at a first level. The output circuit is configured to output a first-level voltage supplied from the first-level providing terminal to the signal output terminal in a case that the first operating voltage is input to the first node by at least one of the first input control circuits, and to output a second-level voltage supplied from the second-level providing terminal to the signal output terminal in a case that the first operating voltage is not input to the first node by each of the plurality of first input control circuits.

In an embodiment, the output circuit includes a first-level output sub-circuit and a second-level output sub-circuit. The second-level output sub-circuit is coupled to the first node, the second power supply terminal, the second-level providing terminal and the signal output terminal. The first-level output sub-circuit is coupled to the first-level providing terminal and the signal output terminal.

In an embodiment, the first-level output sub-circuit includes a first transistor. A gate electrode of the first transistor is coupled to the first-level providing terminal, a first electrode of the first transistor is coupled to the first-level providing terminal, and a second electrode of the first transistor is coupled to the signal output terminal.

In an embodiment, the first-level output sub-circuit further includes a second transistor. The gate electrode of the first transistor is coupled to the first-level providing terminal through the second transistor. A gate electrode of the second transistor is coupled to the first-level providing terminal, a first electrode of the second transistor is couple to the first-level providing terminal, and a second electrode of the second transistor is coupled to the gate electrode of the first transistor.

In an embodiment, the first-level output sub-circuit further comprises a capacitor. A first end of the capacitor is coupled to the gate electrode of the first transistor, and a second end of the capacitor is coupled to the second electrode of the first transistor.

In an embodiment, the second-level output sub-circuit includes a third transistor and a fourth transistor. A gate electrode of the third transistor is coupled to the second power supply terminal, a first electrode of the third transistor is coupled to the second power supply terminal, and a second electrode of the third transistor is coupled to the first node. A gate electrode of the fourth transistor is couple to the first node, a first electrode of the fourth transistor is couple to the signal output terminal, and a second electrode of the fourth transistor is couple to the second-level providing terminal.

In an embodiment, each of the plurality of first input control circuits includes a fifth transistor. A gate electrode of the fifth transistor is coupled to a corresponding signal input terminal, a first electrode of the fifth transistor is coupled to the first node, and a second electrode of the fifth transistor is coupled to the first power supply terminal.

In an embodiment, the signal processing circuit further includes a second input control circuit. The second input control circuit is coupled to the second-level providing terminal and signal input terminals of the first input control circuits respectively, and is coupled to the output circuit at a second node, the second node being coupled to the signal output terminal. The second input control circuit may input the second-level voltage supplied from the second-level providing terminal to the second node in a case that signals respectively supplied to the signal input terminals are at the first level, so that the first-level voltage at the second node is pulled down to the second-level voltage.

In an embodiment, the second input control circuit includes sixth transistors one-to-one corresponding to the signal input terminals respectively, the sixth transistors are coupled in series between the second node and the second-level providing terminal. A gate electrode of each of the sixth transistors is coupled to a corresponding signal input terminal. A first electrode of a sixth transistor at a first stage is coupled to the second node. A first electrode of each of the remaining sixth transistors, except for the sixth transistor at the first stage, is coupled to a second electrode of a sixth transistor at a previous stage. A second electrode of a sixth transistor at a last stage is coupled to the second-level providing terminal.

In an embodiment, all of the first transistor, the second transistor, the third transistor, the fourth transistor, the fifth transistor, and the sixth transistors are thin film transistors of a same type.

In an embodiment, the first level is an active level; and the second level is an inactive level.

In an embodiment, the first-level providing terminal is coupled to the second power supply terminal, and the second-level providing terminal is coupled to the first power supply terminal.

According to an aspect of the disclosure, a display panel including the signal processing circuit described above is provided.

According to an aspect of the disclosure, a display device including the display panel described above is provided.

According to an aspect of the disclosure, a method for driving a signal processing circuit is provided, the method includes: applying a first-level voltage to the first-level providing terminal; applying a second-level voltage to the second-level providing terminal; inputting, by at least one of the plurality of first input control circuits, a first operating voltage supplied from the first power supply terminal to the first node in a case that a signal supplied to a signal input terminal of the at least one of the plurality of first input control circuits is at a first level, so that the output circuit outputs a first-level voltage supplied from the first-level providing terminal to the signal output terminal; and outputting, by the output circuit, a second-level voltage supplied from the second-level providing terminal to the signal output terminal without inputting, by each of the plurality of first input control circuits, the first operating voltage to the first node, in a case that the signal supplied to the signal input terminal of each of the plurality of first input control circuit is at a second level.

In an embodiment, the method further includes: inputting, by the second input control circuit, the second-level voltage supplied from the second-level providing terminal to the second node in a case that signals supplied to the signal input terminals are at the first level, so that the first-level voltage at the second node is pulled down to the second-level voltage.

DETAILED DESCRIPTION

At present, there are two main types of gate drivers: one is a gate driving chip (IC) fixed to a display panel by a bonding process; and the other is a Gate Driver on Array (GOA) circuit directly formed on an array substrate by an Array Process.

The gate driving chip (IC) can output a multi-pulse gate driving signal, but such a gate driving chip (IC) is not beneficial to achieving a narrow bezel design of a display device due to a large space occupied by the gate driving IC. The GOA circuit can facilitate a narrow bezel design of the display device. However, the GOA circuit cannot realize the multi-pulse driving of the gate line, since a shift register at each stage in the GOA circuit can only output a single-pulse driving signal.

In order to enable those skilled in the art to better understand the technical solutions of the present disclosure, a pulse signal processing circuit and a driving process thereof, a display panel and a display device according to the present disclosure are described in detail below with reference to the accompanying drawings.

Figure 1:
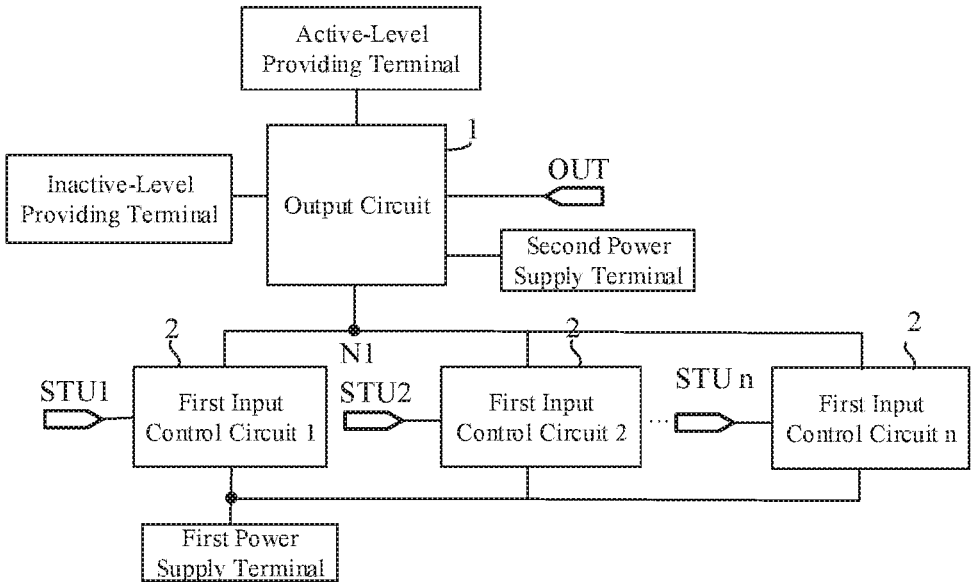
FIG. 1 is a schematic diagram of a circuit structure of a pulse signal processing circuit according to an embodiment of the present disclosure.

FIG. 1 is a schematic diagram of a circuit structure of a pulse signal processing circuit according to an embodiment of the present disclosure. As shown in FIG. 1, the pulse signal processing circuit includes: an output circuit 1 and a plurality of first input control circuits 2. Each of the first input control circuits 2 has a corresponding pulse signal input terminal STU1, STU2, . . . , or STU n. Each of the first input control circuits 2 is coupled to the output circuit 1 at a first node N1.

Each of the first input control circuits 2 is coupled to a first power supply terminal. Each of the first input control circuits 2 may input a first operating voltage supplied from the first power supply terminal to the first node N1 in a case that a pulse signal supplied to a pulse signal input terminal of the first input control circuit 2 is at an active level, and may not input the first operating voltage to the first node N1 in a case that the pulse signal supplied to the pulse signal input terminal of the first input control circuit 2 is at an inactive level.

The output circuit 1 is coupled to an active-level providing terminal, an inactive-level providing terminal, a second power supply terminal and a signal output terminal OUT, respectively. The output circuit 1 may output an active-level voltage supplied from the active-level providing terminal to the signal output terminal OUT in a case that at least one of the first input control circuits 2 inputs the first operating voltage to the first node N1, and may output an inactive-level voltage supplied from the inactive-level providing terminal to the signal output terminal OUT in a case that none of the first input control circuits 2 inputs the first operating voltage to the first node N1.

The pulse signal processing circuit according to the present disclosure has a function of pulse combination. In a case that the pulse signal processing circuit is applied to the GOA circuit, output terminals OUT of at least two shift registers in the GOA circuit are coupled to the signal input terminals STU1, STU2, . . . , and STU n in the pulse signal processing circuit respectively, so that the pulse signal processing circuit can combine single-pulse gate signals output from the at least two shift registers and output a multi-pulse gate driving signal, in order to perform the multi-pulse driving of the gate line. Furthermore, the GOA circuit being used as a gate driver can facilitate the narrow bezel design of the display device.

Therefore, the combination of the pulse signal processing circuit according to the present disclosure and the GOA circuit not only facilitates the narrow bezel design of the display device, but also realizes the multi-pulse driving of the gate line.

It should be noted that the above-mentioned case, where the pulse signal processing circuit cooperates with the GOA circuit to output the multi-pulse gate driving signal, is merely one application scenario of the pulse signal processing circuit, and the application of the pulse signal processing circuit is not limited thereto.

In the present disclosure, the pulse signals input from the pulse signal input terminals STU1 and STU2 may be single-pulse signals, and may also be multi-pulse signals, that is, the pulse signal processing circuit can also combine the multi-pulse signals.

Figure 2:
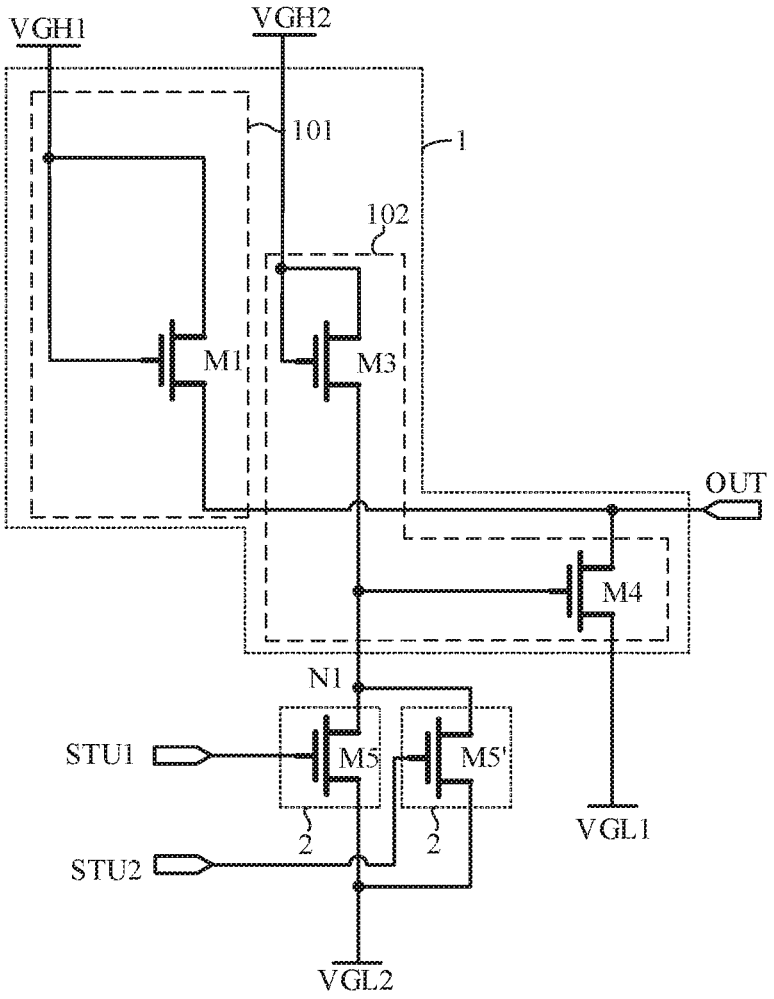
FIG. 2 is a schematic diagram of a circuit structure of a pulse signal processing circuit according to an embodiment of the present disclosure.

FIG. 2 is a schematic diagram of a circuit structure of a pulse signal processing circuit according to an embodiment of the present disclosure. As shown in FIG. 2, the pulse signal processing circuit shown in FIG. 2 is an implementation of the pulse signal processing circuit in FIG. 1.

In the embodiment, a case where the number of first input control circuits 2 is two and the number of pulse signal input terminals is two (that is, STU1 and STU2) is described as an example embodiment.

The output circuit 2 includes an active-level output sub-circuit 101 and an inactive-level output sub-circuit 102.

The inactive-level output sub-circuit 102 is coupled to a first node N1, a second power supply terminal, an inactive-level providing terminal and a signal output terminal OUT, respectively. The inactive-level output sub-circuit 102 may input a second operating voltage VGH2 supplied from the second power supply terminal to the first node N1 in a case that none of the first input control circuits 2 inputs a first operating voltage to the first node N1, and may output an inactive-level voltage VGL1 to the signal output terminal OUT in response to a voltage at the first node N1.

The active-level output sub-circuit 101 is coupled with an active-level providing terminal and the signal output terminal OUT respectively. The active-level output sub-circuit 101 may output an active-level voltage VGH1 to the signal output terminal OUT in a case that at least one of the first input control circuits 2 inputs the first operating voltage VGL2 to the first node N1.

Specifically, the active-level output sub-circuit 101 may include a first transistor M1. A gate electrode of the first transistor M1 is coupled to the active-level providing terminal, a first electrode of the first transistor M1 is coupled to the active-level providing terminal, and a second electrode of the first transistor M1 is coupled to the signal output terminal OUT.

The inactive-level output sub-circuit 102 may include a third transistor M3 and a fourth transistor M4.

A gate electrode of the third transistor M3 is coupled to the second power supply terminal, a first electrode of the third transistor M3 is coupled to the second power supply terminal, and a second electrode the third transistor M3 is coupled to the first node.

A gate electrode of the fourth transistor M4 is coupled to the first node N1, a first electrode of the fourth transistor M4 is coupled to the signal output terminal OUT, and a second electrode of the fourth transistor M4 is coupled to the inactive-level providing terminal.

Each of the first input control circuits 2 may include a fifth transistor M5 or M5'. A gate electrode of the fifth transistor M5 or M5' is coupled to a corresponding pulse signal input terminal STU1 or STU2, a first electrode of the fifth transistor M5 or M5' is coupled to the first node N1, and a second electrode of the fifth transistor M5 or M5' is coupled to a first power supply terminal.

In the embodiment, a case where all transistors in the pulse signal processing circuit are N-type transistor and each of the pulse signals supplied to pulse signal input terminals STU1 and STU2 is positive pulse signal is described as an example embodiment. Further, an active level is a high level, and an inactive level is a low level. The active-level providing terminal provides a high-level voltage VGH1, and the inactive-level providing terminal provides a low-level voltage VGL1. The first operating voltage supplied from the first power supply terminal is a low-level operating voltage VGL2, and the second operating voltage supplied from the second power supply terminal is a high-level operating voltage VGH2. In an embodiment, the active-level providing terminal and the second power supply terminal are coupled with each other, and the inactive-level providing terminal and the first power supply terminal are coupled with each other.

In a case that the pulse signal processing circuit is served as a pulse signal combining circuit (implementing the function of pulse signal combination), the pulse signals supplied to the pulse signal input terminals STU1 and STU2 are activated sequentially during one operating cycle, that is, the case where two pulse signals are both at a high level simultaneously would not exist at any time (i.e., at most one pulse signal is at a high level at any time).

A driving process of the pulse signal processing circuit having two pulse signal input terminals STU1 and STU2 may include the following situations (1) to (3).

In the situation (1), a pulse signal supplied to the pulse signal input terminal STU1 is at a high level, and a pulse signal supplied to the pulse signal input terminal STU2 is at a low level.

In this case, the fifth transistor M5 is turned on, and the fifth transistor M5' is turned off. The low-level operating voltage VGL2 is input to the first node N1 through the fifth transistor M5, so that the first node N1 is at a low-level state and the third transistor M3 is equivalent to a resistor. Since the first node N1 is at the low-level state, the fourth transistor M4 is turned off, so that the inactive-level output sub-circuit does not output the low-level voltage VGL1 to the signal output terminal OUT.

At this time, the high-level voltage VGH1 supplied from the active-level providing terminal is input to the signal output terminal OUT through the first transistor M1, so that the signal output terminal OUT outputs the high-level voltage VGH1.

In the situation (2), the pulse signal supplied to the pulse signal input terminal STU1 is at a low level, and the pulse signal supplied to the pulse signal input terminal STU2 is at a low level.

In this case, the fifth transistor M5 is turned off, and the fifth transistor M5' is turned off. None of the first input control circuits 2 inputs the low-level operating voltage VGL2 to the first node N1. The high-level operating voltage VGH2 supplied from the second power supply terminal is input to the first node N1 through the third transistor M3. Since the first node N1 is at a high-level state, the fourth transistor M4 is turned on, so that the low-level voltage VGL1 is input to the signal output terminal OUT through the fourth transistor M4. At this time, the first transistor M1 is equivalent to a resistor, and the signal output terminal OUT outputs the low-level voltage VGL1.

In the situation (3), the pulse signal supplied to the pulse signal input terminal STU1 is at a low level, and the pulse signal supplied to the pulse signal input terminal STU2 is at a high level.

In this case, the fifth transistor M5 is turned off, and the fifth transistor M5' is turned on. The low-level operating voltage VGL2 is input to the first node N1 through the fifth transistor M5'. The first node N1 is at a low-level state, and the third transistor M3 is equivalent to a resistor. Since the first node N1 is at the low-level state, the fourth transistor M4 is turned off. The inactive-level output sub-circuit does not output the low-level voltage VGL1 to the signal output terminal OUT.

At this time, the high-level voltage VGH1 supplied from the active-level providing terminal is input to the signal output terminal OUT through the first transistor M1, so that the signal output terminal OUT outputs the high-level voltage VGH1.

It can be seen from the above that when the pulse signal processing circuit operates, each of the gate electrodes of the transistors in the pulse signal processing circuit is at a clamped state instead of a floating state, thereby preventing the transistor from being turned on incorrectly due to the floating state of the gate electrode thereof.

Figure 3:
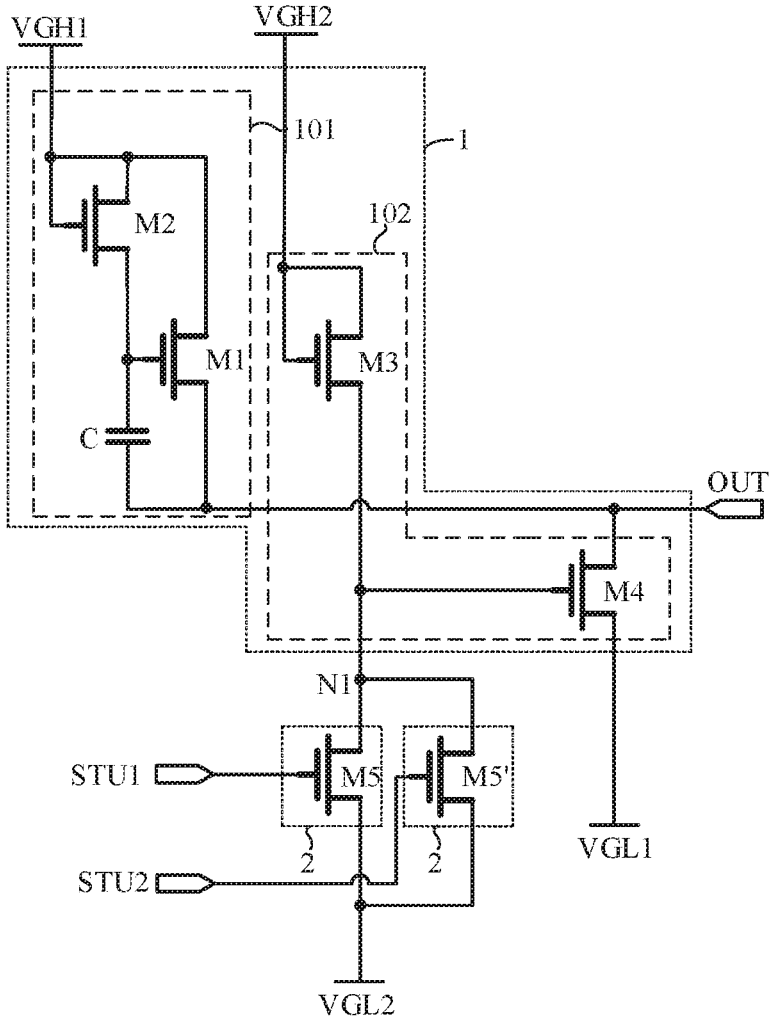
FIG. 3 is a schematic diagram of a circuit structure of a pulse signal processing circuit according to an embodiment of the present disclosure.

FIG. 3 is a schematic diagram of a circuit structure of a pulse signal processing circuit according to an embodiment of the present disclosure. As shown in FIG. 3, compared with the pulse signal processing circuit shown in FIG. 2, the active-level output sub-circuit 101 shown in FIG. 3 may further include a second transistor M2.

The gate electrode of the first transistor M1 is coupled to the active-level providing terminal through the second transistor M2. A gate electrode of the second transistor M2 is coupled to the active-level providing terminal, a first electrode of the second transistor M2 is coupled to the active-level providing terminal, and a second electrode of the second transistor M2 is coupled to the gate electrode of the first transistor M1.

In this case, the second transistor M2 is equivalent to a diode, and can divide a voltage input to the gate electrode of the first transistor M1 from the active-level providing terminal, thereby preventing an increased glitch in a gate voltage of the first transistor M1 when a relative high voltage is input to the first transistor M1.

Furthermore, the active-level output sub-circuit may further include a capacitor C. A first end of the capacitor C is coupled to the gate electrode of the first transistor M1, and a second end of the capacitor C is coupled to the second electrode of the first transistor M1.

During the transition process, from a high level to a low level, of the signal outputted from the signal output terminal OUT, a gate voltage of the first transistor M1 is rapidly pulled down with the bootstrap function of the capacitor C, so that the first transistor M1 is immediately turned off, thereby facilitating rapid input of the low level supplied from the inactive-level providing terminal to the signal output terminal OUT and improving signal inversion speed of the signal output terminal OUT.

Also, during the transition process, from a low level to a high level, of the signal outputted from the signal output terminal OUT, the gate voltage of the first transistor M1 is rapidly pulled up with the bootstrap function of the capacitor C, so that the first transistor M1 is turned on sufficiently, thereby facilitating rapid input of the high level supplied from the active-level providing terminal to the signal output terminal OUT and improving signal inversion speed of the signal output terminal OUT. Additionally, since the first transistor M1 is turned on sufficiently, a problem of threshold loss occurring when the voltage passes through the first transistor M1 can be effectively avoided.

Figure 4:
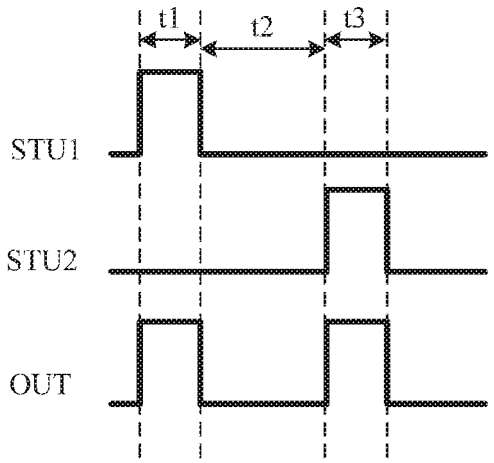
FIG. 4 is a schematic diagram of a driving process of a pulse signal processing circuit according to an embodiment of the present disclosure.

FIG. 4 is a schematic diagram of a driving process of a pulse signal processing circuit in FIG. 3 according to an embodiment of the present disclosure.

As shown in FIG. 3, during a first time period t1, the pulse signal supplied to the pulse signal input terminal STU1 is at an active level, and the pulse signal supplied to the pulse signal input terminal STU2 is at an inactive level. According to the situation (1) described above, the signal output terminal OUT outputs an active-level voltage.

During a second time period t2, the pulse signal supplied to the pulse signal input terminal STU1 is at an inactive level, and the pulse signal supplied to the pulse signal input terminal STU2 is at an inactive level. According to the situation (2) described above, the signal output terminal OUT outputs an inactive-level voltage.

During a third time period t3, the pulse signal supplied to the pulse signal input terminal STU1 is at an inactive level, and the pulse signal supplied to the pulse signal input terminal STU2 is at an active level. According to the situation (3) described above, the signal output terminal OUT outputs an active-level voltage.

It can be seen from above that a multi-pulse signal output from the signal output terminal OUT has a same waveform as that of a combined waveform of the pulse signals supplied to the pulse signal input terminals STU1 and STU2.

In the embodiment, the active-level voltage supplied from the active-level providing terminal is equal to a voltage at which each of the input pulse signals is at the active level. The inactive-level voltage supplied from the inactive-level providing terminal is equal to a voltage at which each of the input pulse signals is at the inactive level. It can be ensured that the pulse signal outputted from the signal output terminal OUT has the same amplitude as that of each of the input pulse signals.

Furthermore, the output circuit 1 may further output the active-level voltage VGH1 supplied from the active-level providing terminal to the signal output terminal OUT in a case that all the first input control circuits 2 input the first operating voltage to the first node N1. In this case, the pulse signal processing circuit according to the embodiment of the present disclosure can not only be served as a pulse signal combining circuit, but can also be served as a logic circuit. In a case that the pulse signal processing circuit is served as a logic circuit, there may be a case that two pulse signals are at an active level simultaneously.

For convenience of description, a signal has a value of "1" in a case that the signal is at a high level, and a signal has a value of "0" in a case that the signal is at a low level.

According to the situation (1) described above, a pulse signal supplied to the pulse signal input terminal STU1 has a value of "1", a pulse signal supplied to the pulse signal input terminal STU2 has a value of "0", and a pulse signal output from the signal output terminal OUT has a value of "1".

According to the situation (2) described above, a pulse signal supplied to the pulse signal input terminal STU1 has a value of "0", a pulse signal supplied to the pulse signal input terminal STU2 has a value of "0", and a pulse signal output from the signal output terminal OUT has a value of "0".

According to the situation (3) described above, a pulse signal supplied to the pulse signal input terminal STU1 has a value of "0", a pulse signal supplied to the pulse signal input terminal STU2 has a value of "1", and a pulse signal output from the signal output terminal OUT has a value of "1".

In a case where a pulse signal supplied to the pulse signal input terminal STU1 has a value of "1" and a pulse signal supplied to the pulse signal input terminal STU2 has a value of "1", the fifth transistor M5 is turned on, and the fifth transistor M5' is turned on. The low-level operating voltage VGL2 is input to the first node N1 through both the fifth transistor M5 and the fifth transistor M5'. The first node N1 is at a low-level state, so that the fourth transistor M4 is turned off. The inactive-level output sub-circuit 102 does not output the low-level voltage VGL1 to the signal output terminal OUT. At this time, the high-level voltage VGH1 supplied from the active-level providing terminal is input to the signal output terminal OUT through the first transistor M1, and the signal output terminal OUT outputs the high-level voltage VGH1, that is, the pulse signal output from the signal output terminal OUT has a value of "1".

The truth table of the pulse signal input terminals STU1 and STU2 and the output terminal OUT of the pulse signal processing circuit shown in FIG. 3 is as follows:

| STU1 | STU2 | OUT |
|---|---|---|
| 0 | 0 | 0 |
| 1 | 0 | 1 |
| 0 | 1 | 1 |
| 1 | 1 | 1 |

It can be seen that the pulse signal processing circuit according to the embodiment can also perform a logical OR operation, that is, the pulse signal processing circuit can be served as a logic OR gate circuit.

Figure 5:
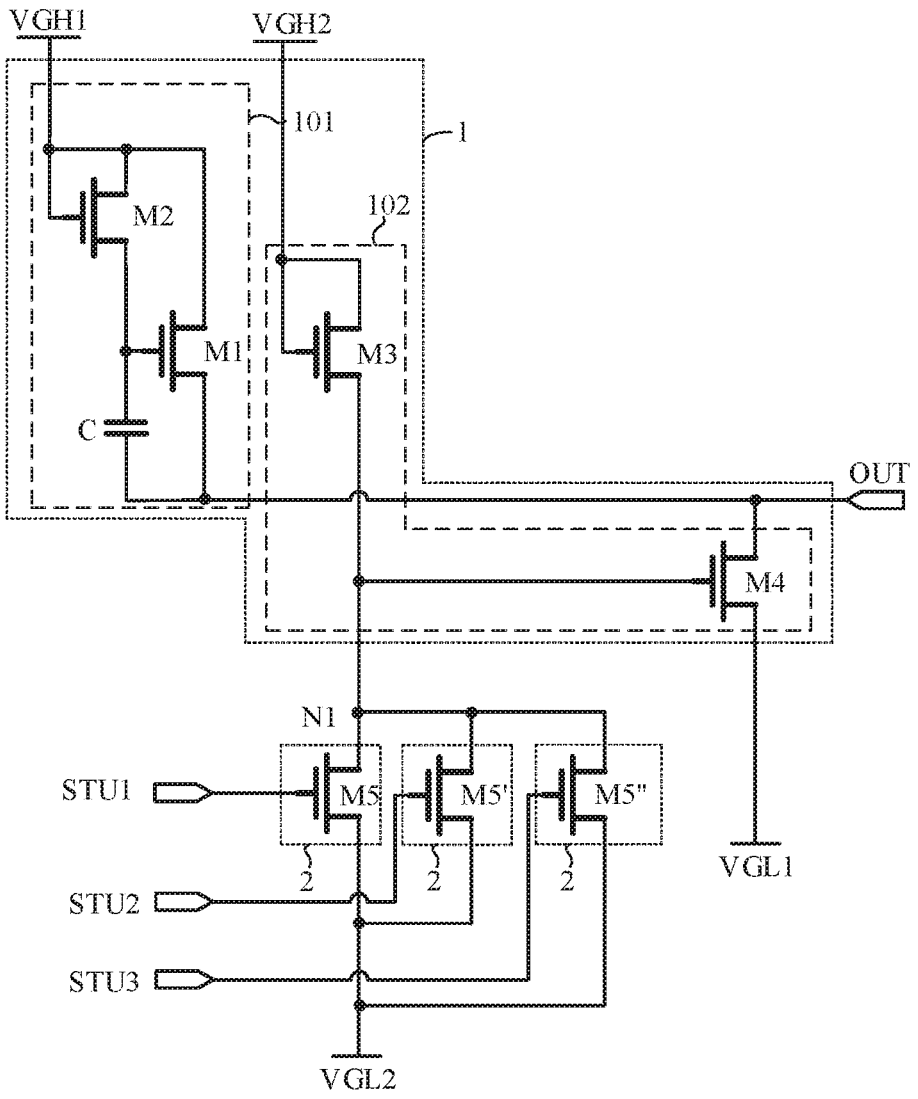
FIG. 5 is a schematic diagram of a circuit structure of a pulse signal processing circuit according to an embodiment of the present disclosure.

FIG. 5 is a schematic diagram of a circuit structure of a pulse signal processing circuit according to an embodiment of the present disclosure. The pulse signal processing circuit shown in FIG. 5 is different from the pulse signal processing circuit shown in FIG. 4 in that the number of the first input control circuits 2 in the pulse signal processing circuit of FIG. 5 is three (3).

In a case where all the pulse signals supplied to the pulse signal input terminals STU1, STU2 and STU3 are at a low level (i.e., an inactive level), each of the fifth transistor M5 and the fifth transistor M5' is turned off. The high-level operating voltage VGH2 supplied from the second power supply terminal is input to the first node N1 through the third transistor M3. Since the first node N1 is at a high level, the fourth transistor M4 is turned on, so that the low-level voltage VGL1 is input to the signal output terminal OUT through the fourth transistor M4. At this time, the first transistor M1 is equivalent to a resistor, and the signal output terminal OUT outputs the low-level voltage VGL1.

In a case where at least one of the pulse signals supplied to the pulse signal input terminals STU1, STU2 and STU3 is at a high level (i.e., an active level), at least one of the fifth transistors is turned on. At this time, the low-level operating voltage VGL2 is input to the first node N1 through the at least one fifth transistor that is turned-on, so that the fourth transistor M4 is turned off. The inactive-level output sub-circuit 102 does not output the low-level voltage VGL1 to the signal output terminal OUT. The high-level voltage VGH1 supplied from the active-level providing terminal is input to the signal output terminal OUT through the first transistor M1, so that the signal output terminal OUT outputs the high-level voltage VGH1.

It should be noted in a case that the pulse signal processing circuit is served as a pulse signal combining circuit, the pulse signals supplied to the pulse signal input terminals STU1, STU2 and STU3 are activated sequentially during one operating cycle, that is, at most one pulse signal is at a high level at any time.

In a case that the pulse signal processing circuit is served as a logic OR circuit (a logic OR circuit with multiple inputs), there may be a case that two or more pulse signals are at an active level simultaneously.

Figure 6:
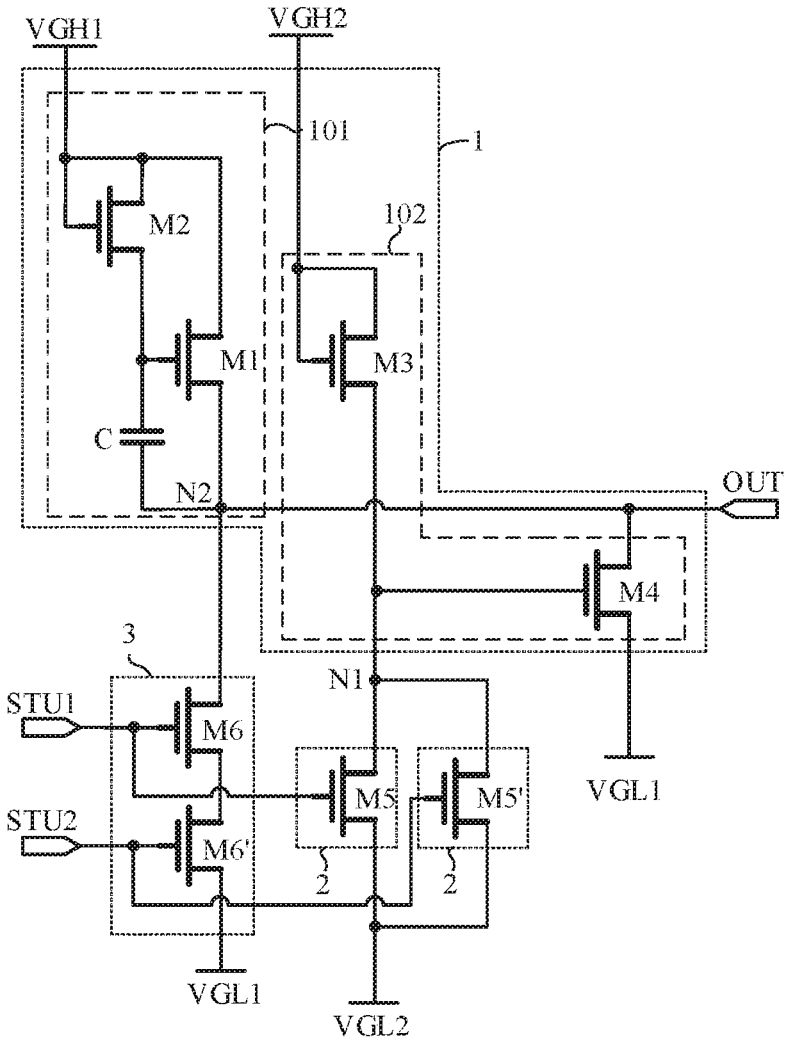
FIG. 6 is a schematic diagram of a circuit structure of a pulse signal processing circuit according to an embodiment of the present disclosure.

FIG. 6 is a schematic diagram of a circuit structure of a pulse signal processing circuit according to an embodiment of the present disclosure. As shown in FIG. 6, the pulse signal processing circuit in FIG. 6 is different from the pulse signal processing circuits in above embodiments in that a second input control circuit 3 is also included in addition to the output circuit 1 and the first input control circuits 2. The second input control circuit 3 is coupled to the inactive-level providing terminal, the signal output terminal OUT, and the pulse signal input terminals STU1 and STU2, respectively. The second input control circuit 3 and the output circuit 1 are coupled at a second node N2. The second node N2 is coupled to the signal output terminal OUT. The second input control circuit 3 may input an inactive-level voltage to the signal output terminal OUT in a case that both the pulse signals supplied to the pulse signal input terminals STU1 and STU2 are at an active level.

For the description of the output circuit 1 and the first input control circuits 2, reference may be made to the contents of the foregoing embodiments, and the details thereof are omitted herein.

The second input control circuit 3 may include sixth transistors M6 and M6', the sixth transistors correspond to the signal input terminals STU1 and STU2 in a one-to-one correspondence relationship. All of the sixth transistors M6 and M6' are coupled in series between the second node N2 and the inactive-level providing terminal. A gate electrode of each of the sixth transistors M6 and M6' is coupled to a corresponding signal input terminal, that is, STU1 or STU2. A first electrode of a sixth transistor at a first stage is coupled to the second node; a first electrode of each of the remaining sixth transistors, except for the sixth transistor at the first stage, is coupled to a second electrode of a sixth transistor at a previous stage; and a second electrode of a sixth transistor at a last stage is coupled to the inactive-level providing terminal.

In the embodiment, a case where the number of the first input control circuits 2 is two, all transistors in the pulse signal processing circuit are N-type transistor and pulse signals supplied to the pulse signal input terminals STU1 and STU2 are positive pulse signals is described as an example embodiment. Further, an active level is a high level, and an inactive level is a low level. The active-level providing terminal provides a high-level voltage VGH1, and the inactive-level providing terminal provides a low-level voltage VGL1. The first operating voltage supplied from the first power supply terminal is a low-level operating voltage VGL2, and the second operating voltage supplied from the second power supply terminal is a high-level operating voltage VGH2.

In a case that the pulse signal processing circuit is served as a pulse signal combining circuit, the pulse signals supplied to the pulse signal input terminals STU1 and STU2 are activated sequentially during one operating cycle, that is, the case where two pulse signals are both at a high level simultaneously would not exist at any time (i.e., at most one pulse signal is at a high level at any time). Therefore, at most one of the sixth transistors is turned on at any time, in this case, the inactive-level providing terminal cannot be electrically coupled to the signal output terminal OUT through the sixth transistors M6 and M6' (the second input control circuit 3 is always in an open (turned-off) state), that is, the inactive-level voltage cannot be input to the signal output terminal OUT by the second input control circuit 3. In this case, the pulse signal processing circuit as shown in FIG. 6 is equivalent to the pulse signal processing circuit as shown in FIG. 3. As can be seen from the description in the foregoing embodiments, the pulse signal processing circuit can implement the combination of the pulse signals supplied to the pulse signal input terminals STU1 and STU2, and the details thereof are omitted herein.

The pulse signal processing circuit according to the embodiment of the present disclosure can not only be served as a pulse signal combining circuit, but can also be served as a logic circuit. In a case that the pulse signal processing circuit is served as a logic circuit, there may be a case that two pulse signals are at an active level simultaneously. For convenience of description, a signal has a value of "1" in a case that the signal is at a high level, and a signal has a value of "0" in a case that the signal is at a low level.

In a case where a pulse signal supplied to the pulse signal input terminal STU1 and/or STU2 has a value of "0", the pulse signal processing circuit as shown in FIG. 6 is equivalent to the pulse signal processing circuit as shown in FIG. 3. In this case, the output process of the signal output terminal OUT of the pulse signal processing circuit shown in FIG. 6 is the same as that of the signal output terminal OUT of the pulse signal processing circuit shown in FIG. 3, and the details thereof is omitted herein.

A case where a pulse signal supplied to the pulse signal input terminal STU1 has a value of "1" and a pulse signal supplied to the pulse signal input terminal STU2 has a value of "1" is described in detail below.

In a case where a pulse signal supplied to the pulse signal input terminal STU1 has a value of "1" and a pulse signal supplied to the pulse signal input terminal STU2 has a value of "1", the fifth transistor M5 is turned on, the fifth transistor M5' is turned on, the sixth transistor M6 is turned on, and the sixth transistor M6' is turned on. The low-level operating voltage VGL2 is input to the first node N1 through the fifth transistor M5 and the fifth transistor M5'. The first node N1 is at a low level, so that the fourth transistor M4 is turned off. The inactive-level output sub-circuit 102 does not output the low-level voltage VGL1 to the signal output terminal OUT.

At the same time, the low-level voltage VGL1 supplied from the inactive-level providing terminal is input to the second node N2 (i.e., the signal output terminal OUT) through the sixth transistor M6 and the sixth transistor M6', so that the signal output terminal OUT outputs the low-level voltage VGL1, that is, the pulse signal output from the signal output terminal OUT has a value of "0".

In other words, in a case where a pulse signal supplied to the pulse signal input terminal STU1 has a value of "1" and a pulse signal supplied to the pulse signal input terminal STU2 has a value of "1", the high-level voltage VGH1 at the second node N2 supplied from the active-level providing terminal is pulled down to the low-level voltage VGL1, so that the low-level voltage VGL1 is output to the signal output terminal OUT.

The truth table of the pulse signal input terminals STU1 and STU2 and the output terminal OUT of the pulse signal processing circuit shown in FIG. 6 is as follows:

| STU1 | STU2 | OUT |
|---|---|---|
| 0 | 0 | 0 |
| 1 | 0 | 1 |
| 0 | 1 | 1 |
| 1 | 1 | 0 |

It can be seen that the pulse signal processing circuit according to the embodiment can also perform a logical XOR operation, that is, the pulse signal processing circuit can be served as a logic XOR gate circuit.

Figure 7:
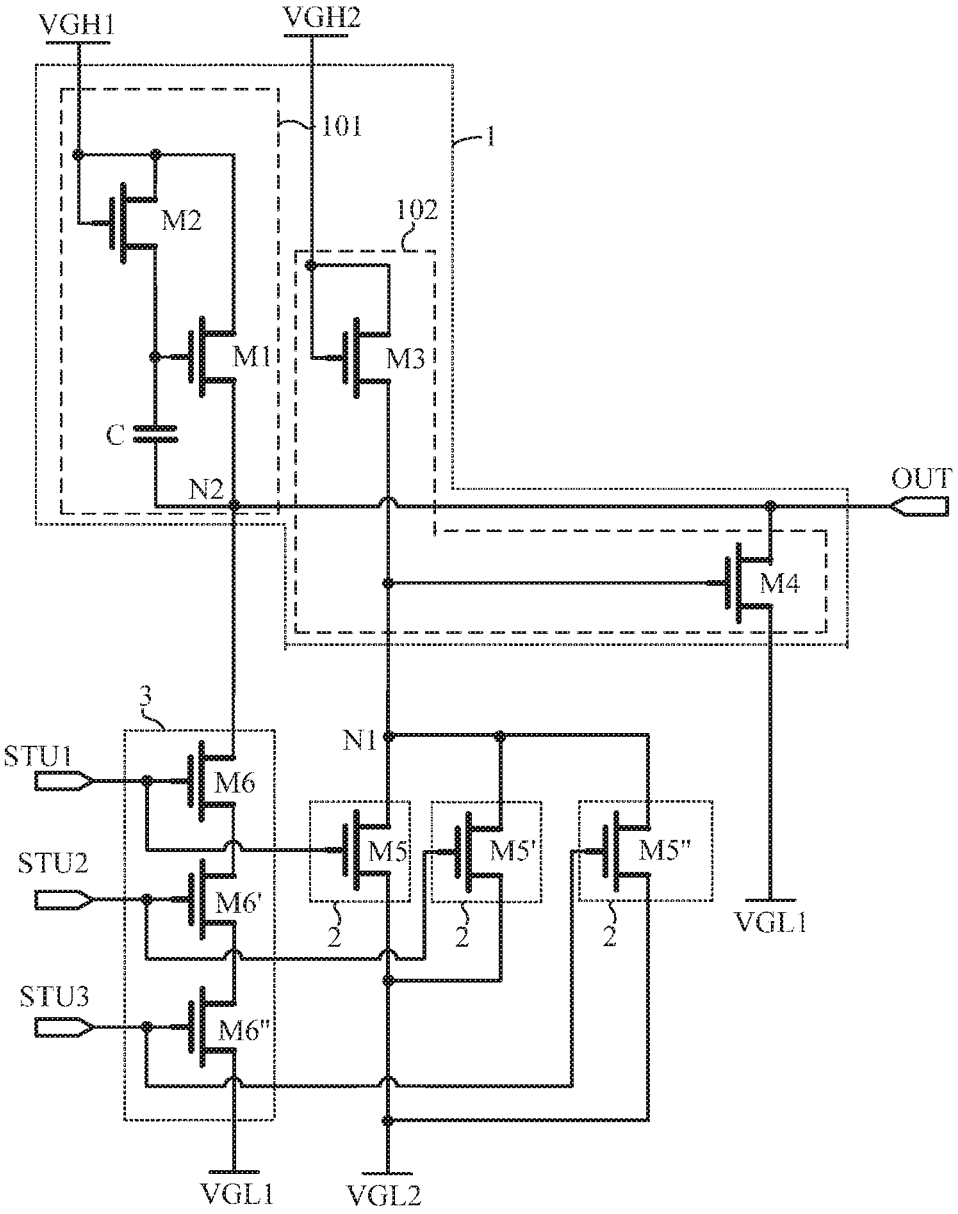
FIG. 7 is a schematic diagram of a circuit structure of a pulse signal processing circuit according to an embodiment of the present disclosure.

FIG. 7 is a schematic diagram of a circuit structure of a pulse signal processing circuit according to an embodiment of the present disclosure. As shown in FIG. 7, the pulse signal processing circuit shown in FIG. 7 is different from the pulse signal processing circuit shown in FIG. 6 in that the number of the first input control circuits 2 in the pulse signal processing circuit of FIG. 7 is three.

In a case where all the pulse signals supplied to the pulse signal input terminals STU1, STU2 and STU3 are at a low level (i.e., an inactive level), all the fifth transistors M5, M5' and M5" are turned off. The high-level operating voltage VGH2 supplied from the second power supply terminal is input to the first node N1 through the third transistor M3. Since the first node N1 is at a high-level state, the fourth transistor M4 is turned on, so that the low-level voltage VGL1 is input to the signal output terminal OUT through the fourth transistor M4. At this time, the first transistor M1 is equivalent to a resistor, and the signal output terminal OUT outputs the low-level voltage VGL1.

In a case where some of the pulse signals supplied to the pulse signal input terminals STU1, STU2 and STU3 are at a high level (i.e., an active level), at least one of the fifth transistors is turned on. At this time, the low-level operating voltage VGL2 is input to the first node N1 through the at least one fifth transistor that is turned-on, so that the fourth transistor M4 is turned off. The inactive-level output sub-circuit 102 does not output the low-level voltage VGL1 to the signal output terminal OUT. The high-level voltage VGH1 supplied from the active-level providing terminal is input to the second node N2 through the first transistor M1, so that the signal output terminal OUT outputs the high-level voltage VGH1.

In a case where all the pulse signals supplied to the pulse signal input terminals STU1, STU2 and STU3 are at a high level (i.e., an active level), all the sixth transistors M6, M6' and M6" are turned on. At this time, the low-level voltage VGL1 is input to the signal output terminal OUT through the sixth transistors M6, M6' and M6", and the signal output terminal OUT outputs the low-level voltage VGL1. In other words, the high-level voltage VGH1 at the second node N2 is pull down to the low-level voltage VGL1, and the low-level voltage VGL1 is output to the signal output terminal OUT.

It should be noted in a case that the pulse signal processing circuit is served as a pulse signal combining circuit, the pulse signals supplied to the pulse signal input terminals STU1, STU2 and STU3 are activated sequentially during one operating cycle, that is, at most one pulse signal is at a high level at any time.

When the pulse signal processing circuit is served as a logic circuit (a logic circuit with multiple inputs, the logic circuit outputs "0" only in a case that all of the input pulse signals are in a same state, and outputs "1" in other cases), there may be a case that two or more pulse signals are at an active level simultaneously.

It should be noted that the above-described embodiments are merely illustrative, and the technical solutions of the present disclosure are not limited thereto. It should be known to those skilled in the art that the number of the pulse signal input circuits in the present disclosure may be four, five or more, and the examples are not exemplified herein. The pulse signal processing circuit according to the present disclosure can not only implement a function of pulse combination, but can also perform a specific logic operation.

In addition, each of the transistors in the pulse signal processing circuit according to the present disclosure may also be a P-type transistor. In this case, the pulse signal processing circuit may process negative pulse signals (i.e., an active level is a low level, and an inactive level is a high level). The active-level providing terminal provides a low-level voltage, and the inactive-level providing terminal provides a high-level voltage. A first operating voltage supplied from the first power supply terminal is a high-level operating voltage, and a second operating voltage supplied from the second power supply terminal is a low-level operating voltage.

Since each of the transistors in the pulse signal processing circuit is an N-type transistor or a P-type transistor, each of the transistors may be prepared simultaneously by using a same manufacturing process, thereby shortening the manufacturing cycle and improving the manufacturing efficiency. Each of the transistors may be a TFT transistor or a MOS transistor. In a case where each of the transistors is a TFT transistor, the pulse signal processing circuit according to the present disclosure may be applied to a liquid crystal display panel.

A display panel is provided according to an embodiment of the disclosure. The display panel may include a pulse signal processing circuit. The pulse signal processing circuit may be the pulse signal processing circuit according to any one of the embodiments described above.

As a specific application, the output terminals OUT of the gate driver are coupled to the signal input terminals of the pulse signal processing circuit respectively; so that the pulse signal processing circuit can combine the pulse signals output from the gate driver to obtain a multi-pulse gate driving signal, and output the multi-pulse gate driving signal to a corresponding gate line so as to perform the multi-pulse driving of the gate line.

Furthermore, the GOA circuit being used as the gate driver can facilitate the narrow bezel design of the display device.

As another application, the pulse signal processing circuit can also be served as a logic circuit integrated in a pixel circuit of an Organic Light-Emitting Diode (©LED) display panel.

Certainly, it should be understood by those skilled in the art that the application of the pulse signal processing circuit according to the present disclosure is not limited thereto.

A display device is provided according to an embodiment of the present disclosure, the display device may include a display panel. The display panel may be the display panel according to the above embodiments.

It should be understood that the above embodiments are merely exemplary embodiments for the purpose of illustrating the principles of the present disclosure, and the present disclosure is not limited thereto. It should be apparent to those skilled in the art that various changes and modifications can be made without departing from the spirit and essence of the present disclosure, which are also to be regarded as within the scope of the present disclosure.

What is claimed is:

1. A signal processing circuit, comprising:

a first-level providing terminal;

a second-level providing terminal;

a first power supply terminal;

a second power supply terminal;

a signal output terminal;

an output circuit coupled to the first-level providing terminal, the second level-providing terminal, the second power supply terminal, and the signal output terminal; and a plurality of first input control circuits, each of which is coupled to the first power supply terminal, coupled to the output circuit at a first node, and has a signal input terminal, wherein each of the plurality of first input control circuits is configured to input a first operating voltage supplied from the first power supply terminal to the first node in a case that a signal supplied to the signal input terminal of the first input control circuit is at a first level, and the output circuit is configured to output a first-level voltage supplied from the first-level providing terminal to the signal output terminal in a case that the first operating voltage is input to the first node by at least one of the first input control circuits, and to output a second-level voltage supplied from the second-level providing terminal to the signal output terminal in a case that the first operating voltage is not input to the first node by each of the plurality of first input control circuits.

2. The signal processing circuit according to claim 1, wherein the output circuit comprises a first-level output sub-circuit and a second-level output sub-circuit;

the second-level output sub-circuit is coupled to the first node, the second power supply terminal, the second-level providing terminal and the signal output terminal; and the first-level output sub-circuit is coupled to the first-level providing terminal and the signal output terminal.

3. The signal processing circuit according to claim 2, wherein the first-level output sub-circuit comprises a first transistor; and a gate electrode of the first transistor is coupled to the first-level providing terminal, a first electrode of the first transistor is coupled to the first-level providing terminal, and a second electrode of the first transistor is coupled to the signal output terminal.

4. The signal processing circuit according to claim 3, wherein the first-level output sub-circuit further comprises a second transistor;

the gate electrode of the first transistor is coupled to the first-level providing terminal through the second transistor; and a gate electrode of the second transistor is coupled to the first-level providing terminal, a first electrode of the second transistor is couple to the first-level providing terminal, and a second electrode of the second transistor is coupled to the gate electrode of the first transistor.

5. The signal processing circuit according to claim 4, wherein the first-level output sub-circuit further comprises a capacitor; and a first end of the capacitor is coupled to the gate electrode of the first transistor, and a second end of the capacitor is coupled to the second electrode of the first transistor.

6. The signal processing circuit according to claim 5, wherein the second-level output sub-circuit comprises a third transistor and a fourth transistor;

a gate electrode of the third transistor is coupled to the second power supply terminal, a first electrode of the third transistor is coupled to the second power supply terminal, and a second electrode of the third transistor is coupled to the first node; and a gate electrode of the fourth transistor is couple to the first node, a first electrode of the fourth transistor is couple to the signal output terminal, and a second electrode of the fourth transistor is couple to the second-level providing terminal.

7. The signal processing circuit according to claim 6, wherein each of the plurality of first input control circuits comprises a fifth transistor; and a gate electrode of the fifth transistor is coupled to a corresponding signal input terminal, a first electrode of the fifth transistor is coupled to the first node, and a second electrode of the fifth transistor is coupled to the first power supply terminal.

8. The signal processing circuit according to claim 7, further comprising a second input control circuit, wherein the second input control circuit is coupled to the second-level providing terminal and signal input terminals of the first input control circuits respectively, and is coupled to the output circuit at a second node, the second node being coupled to the signal output terminal, and the second input control circuit is configured to input the second-level voltage supplied from the second-level providing terminal to the second node in a case that signals respectively supplied to the signal input terminals are at the first level, so that the first-level voltage at the second node is pulled down to the second-level voltage.

9. The signal processing circuit according to claim 8, wherein the second input control circuit comprises sixth transistors one-to-one corresponding to the signal input terminals respectively, the sixth transistors are coupled in series between the second node and the second-level providing terminal;

a gate electrode of each of the sixth transistors is coupled to a corresponding signal input terminal;

a first electrode of a sixth transistor at a first stage is coupled to the second node;

a first electrode of each of the remaining sixth transistors, except for the sixth transistor at the first stage, is coupled to a second electrode of a sixth transistor at a previous stage; and a second electrode of a sixth transistor at a last stage is coupled to the second-level providing terminal.

10. The signal processing circuit according to claim 9; wherein all of the first transistor, the second transistor, the third transistor, the fourth transistor, the fifth transistor, and the sixth transistors are thin film transistors of a same type.

11. The signal processing circuit according to claim 2, wherein the second-level output sub-circuit comprises a third transistor and a fourth transistor;

a gate electrode of the third transistor is coupled to the second power supply terminal, a first electrode of the third transistor is coupled to the second power supply terminal, and a second electrode of the third transistor is coupled to the first node; and a gate electrode of the fourth transistor is couple to the first node, a first electrode of the fourth transistor is couple to the signal output terminal, and a second electrode of the fourth transistor is couple to the second-level providing terminal.

12. The signal processing circuit according to claim 1, wherein each of the plurality of first input control circuits comprises a fifth transistor; and a gate electrode of the fifth transistor is coupled to a corresponding signal input terminal, a first electrode of the fifth transistor is coupled to the first node, and a second electrode of the fifth transistor is coupled to the first power supply terminal.

13. The signal processing circuit according to claim 1, further comprising a second input control circuit, wherein the second input control circuit is coupled to the second-level providing terminal and signal input terminals of the first input control circuits respectively, and is coupled to the output circuit at a second node, the second node being coupled to the signal output terminal, and the second input control circuit is configured to input the second-level voltage supplied from the second-level providing terminal to the second node in a case that signals respectively supplied to the signal input terminals are at the first level, so that the first-level voltage at the second node is pulled down to the second-level voltage.

14. The signal processing circuit according to claim 1, wherein the first level is an active level; and the second level is an inactive level.

15. The signal processing circuit according to claim 1, wherein the first-level providing terminal is coupled to the second power supply terminal, and the second-level providing terminal is coupled to the first power supply terminal.

16. A display panel, comprising the signal processing circuit according to claim 1.

17. A display device, comprising the display panel according to claim 16.

18. A method for driving a signal processing circuit, wherein the signal processing circuit comprises: a first-level providing terminal; a second-level providing terminal; a first power supply terminal; a second power supply terminal; a signal output terminal; an output circuit coupled to the first-level providing terminal, the second-level providing terminal; the second power supply terminal, and the signal output terminal; and a plurality of first input control circuits, each of which is coupled to the first power supply terminal, coupled to the output circuit at a first node, and has a signal input terminal, wherein the method comprises:

applying a first-level voltage to the first-level providing terminal;

applying a second-level voltage to the second-level providing terminal;

inputting, by at least one of the plurality of first input control circuits, a first operating voltage supplied from the first power supply terminal to the first node in a case that a signal supplied to a signal input terminal of the at least one of the plurality of first input control circuits is at a first level, so that the output circuit outputs a first-level voltage supplied from the first-level providing terminal to the signal output terminal; and outputting, by the output circuit, a second-level voltage supplied from the second-level providing terminal to the signal output terminal without inputting, by each of the plurality of first input control circuits, the first operating voltage to the first node, in a case that the signal supplied to the signal input terminal of each of the plurality of first input control circuit is at a second level.

19. The method according to claim 18, wherein the signal processing circuit further comprises a second input control circuit, wherein the second input control circuit is coupled to the second-level providing terminal and signal input terminals of the first input control circuits respectively, and is coupled to the output circuit at a second node, the second node being coupled to the signal output terminal, wherein the method further comprises:

inputting, by the second input control circuit, the second-level voltage supplied from the second-level providing terminal to the second node in a case that signals supplied to the signal input terminals are at the first level, so that the first-level voltage at the second node is pulled down to the second-level voltage.

20. The method according to claim 18, wherein the first level is an active level, and the second level is an inactive level.

* * * * *